US005326952A

United States Patent [19]

Ipcinski

[11] Patent Number: 5,326,952

[45] Date of Patent: Jul. 5, 1994

[54] ELECTRIC SWITCH

[75] Inventor: Ralph G. Ipcinski, Hollis, N.H.

[73] Assignee: C & K Components, Inc., Newton, Mass.

[21] Appl. No.: 64,894

[22] Filed: May 24, 1993

[51] Int. Cl.[5] ..... H01H 13/14

[52] U.S. Cl. ..... 200/530; 200/531; 200/293; 200/303

[58] Field of Search ..... 200/530, 531, 533, 537, 200/538, 539, 540, 541, 542, 345, 293, 303, 277.1

[56] References Cited

U.S. PATENT DOCUMENTS 3,235,678 2/1966 Woodcock ..... 200/530
3,379,851 4/1968 Weremey ..... 200/530
4,079,220 3/1978 Wagner et al. ..... 200/530
4,355,216 10/1982 Kane et al. ..... 200/303
5,063,276 11/1991 Woodward ..... 200/530

FOREIGN PATENT DOCUMENTS 132717 8/1947 Netherlands ..... 200/277.1

*Primary Examiner*—Henry J. Recla
*Assistant Examiner*—David J. Walczak

[57] ABSTRACT

This is an electric switch having an actuator with a transversely located movable contact moving within a housing having two parallel fixed contacts, the actuator includes projections from the exterior walls thereof, which ride in cutaways formed in the housing.

3 Claims, 4 Drawing Sheets

ELECTRIC SWITCH

BACKGROUND OF THE INVENTION

This present invention relates generally to mechanical electric switches.

SUMMARY OF THE INVENTION

A switch in which the movable contact engages between two flexible fixed contacts.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 2:
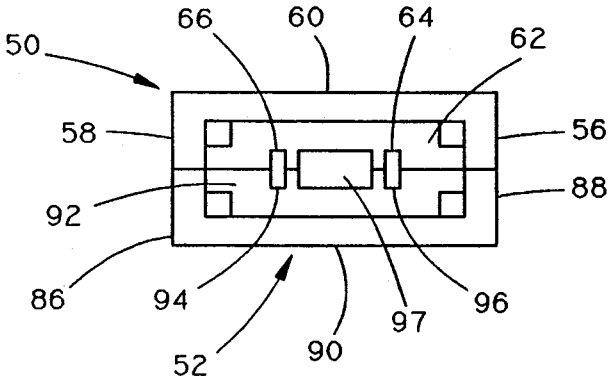
FIG. 2 is a top plan view of the assembled housing with the cap removed according to the present invention.

There is shown in the drawings a switch 10 comprising actuator 12, movable contact 14, a housing 16, a first fixed contact 18, a second fixed contact 10 and a bracket 22. The actuator 12 and the housing 16 are formed of a plastic material. The movable contact 14, the first fixed contact 18, the second fixed contact 20 and the bracket 22 are formed of a metallic material.

The actuator 12 is of cubic one piece construction including a cup like cavity 24 and a bottom surface 26. The bottom surface 26 defines the openings 28 into the cavity 24. The actuator 12 also has a block portion 29 from which four wall portions 30*a*, 30*b*, 30*c*, 30*d* extend to define the cavity 24 and the block portion 29 includes an upper surfaces 32. The upper surface 32 has a cap 34 integrally mounted thereon. The external surface of the wall portion 30*a* of the actuator 12 includes a first projection 36 and the external surface of the wall portion 30*c* of the actuator 12 includes a second projection 38 which integrally extend therefrom. The first projection 36 includes a first right angle surface 40 and a first angled surface 42 which extends from the first right angle surface 40 to the external surface 30. The second projection 38 includes a second right angle surface 44 and a second angled surface 46 which extends from the second right angle surface 44 to the external surface 30. The cap 34 has a circumferential edge 48 which is turned upwardly away from the upper surface 32 of the actuator 12. The opposed wall portions 30*b*, 30*d* have a through hole 45 whose diameter is equal to the diameter of the movable contact 14.

Figure 1:
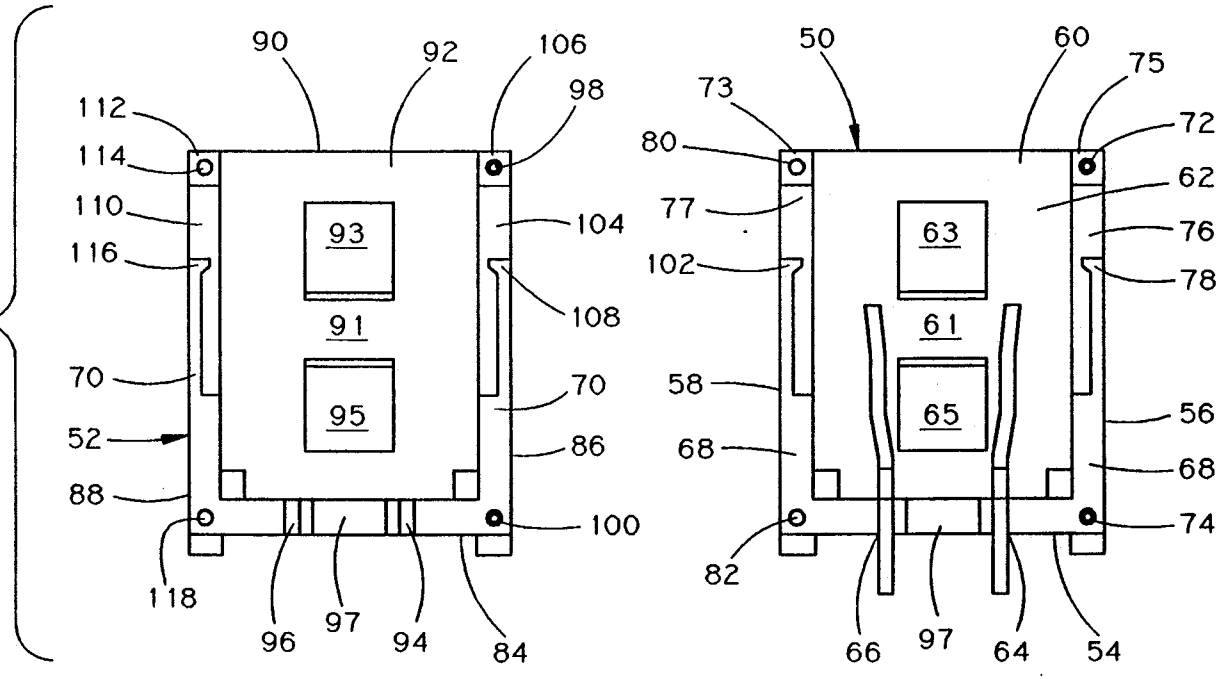
FIG. 1 is a plan view of the two portions of the housing with the fixed contacts positioned according to the present invention.
Figure 4:
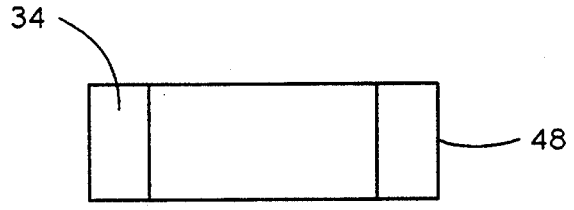
FIG. 4 is a top plan view of the assembled housing shown in FIG. 3.
Figure 6:
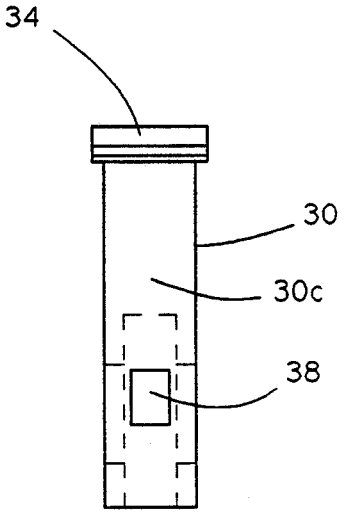
FIG. 6 is an end elevational view of the assembled housing shown in FIG. 3.
Figure 3:
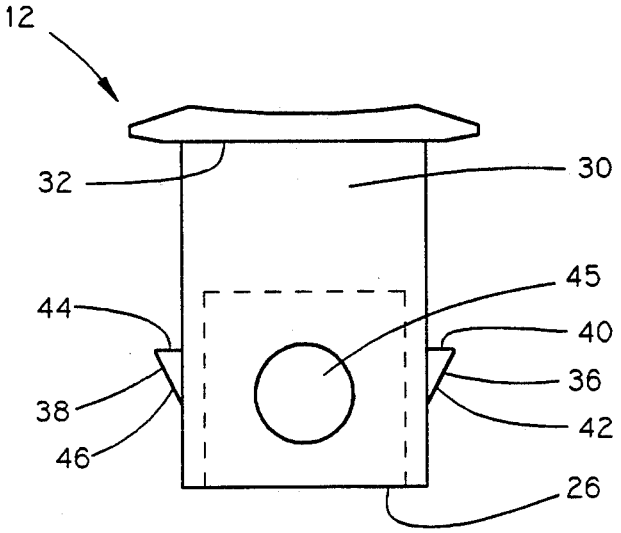
FIG. 3 is a side elevational view of the assembled housing with the cap according to the present invention.
Figure 5:
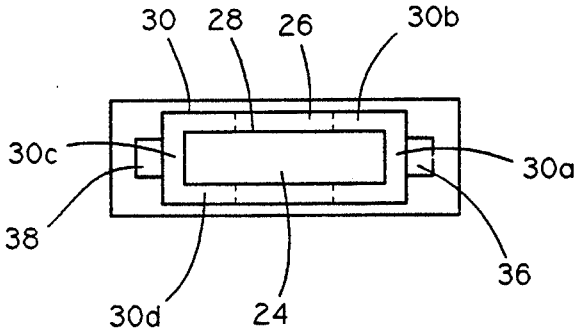
FIG. 5 is a bottom plan view of the assembled housing shown in FIG. 3.
Figure 7:
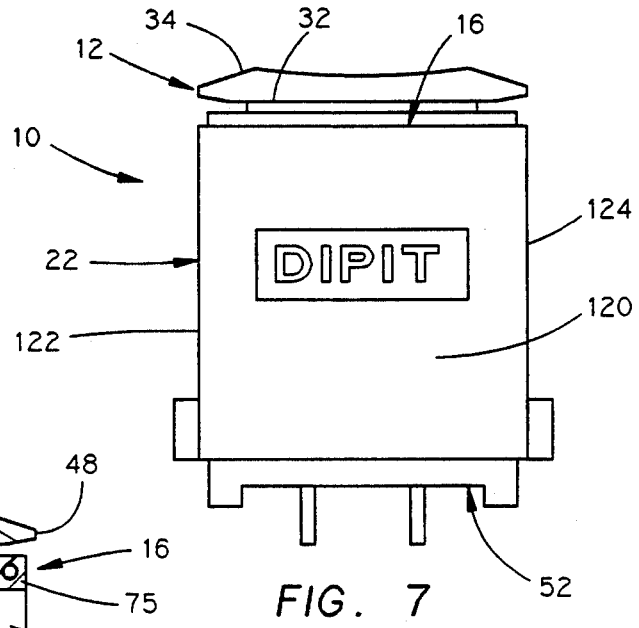
FIG. 7 is a front side elevational view of the assembled switch according to the present invention.

The housing 16 is formed from a first portion 50 and a second portion 52 which are identical to each other. The first portion 50 includes a first bottom wall 54, first and second long side walls 56, 58, a first external wall 60 and a first cavity section 62. The first external wall 60 is generally rectangular in configuration and has an inner surface and side edges. The first external wall 60 includes a centrally positioned first land 61 which separates a first generally rectangular depression 63 from a second generally rectangular depression 65. The edges of the first land 61 adjacent the first and second depression 63, 65 are arced as indicated in FIG. 1. The first bottom wall 54 and the first and second long side walls 56, 58 extend integrally from the inner surface of the first external wall 60 defining a first cavity section 62 and an upper opening as shown in FIG. 1. First and second half openings 64, 66 are formed through the first bottom wall 54 from the exterior of the switch 10 to the first cavity section 62 in spaced parallel relation to each other. A first abutting surface 68 is provided on the first bottom wall 54, the first and the second long side walls 56, 58. A first post 72 extends from the top end of the first long side wall 56 as shown in FIG. 1. A second post 74 extends from the junction of the first long side wall 56 and the first bottom wall 54. A first cutaway 76 is formed on the first abutting surface of the first long side wall 56 as shown in FIG. 1. The first cutaway 76 terminates in a rectangular first stop 75 from which the first post 72 extends. A first arm portion 78 is provided when the first cutaway 76 is formed as shown in FIG. 1. A second cutaway 77 is formed on the first abutting surface of the second long side wall 58. The second cutaway 77 terminates in a rectangular second stop 73 on which a first blind aperture 80 is formed. A second arm portion 102 is provided when the second cutaway 77 is formed as shown in FIG. 1. A second blind aperture 82 is formed at the junction of the second long side wall 58 and the first bottom wall 54 as shown in FIG. 1.

The second portion 52 includes a second bottom wall 84, third and fourth long side walls 86, 88, a second external wall 90 and a second cavity section 92. The second external wall 90 is generally rectangular in configuration and has an inner surface and side edges. The second external wall 90 includes a centrally positioned second land 91 which separates a third generally rectangular depression 93 from a fourth generally rectangular depression 95. The edges of the second land 91 adjacent the third and fourth depressions 93, 95 are arced as indicated in FIG. 1. The second bottom wall 84 and the third and fourth long side walls 86, 88 extend integrally from the inner surface of the second external wall 90 defining the second cavity section 92 and an upper opening as shown in FIG. Third and fourth half openings 94, 96 are formed through the second bottom wall 84 from the exterior of the switch 10 to the second cavity section 92 in spaced parallel relation to each other. A second abutting surface 70 is provided on the second bottom wall 84, the third long side wall 86 and the fourth long side wall 88. A third post 98 extends from the top end of the third long side wall 86 as shown in FIG. 1. A fourth post extends from the junction of the fourth long side wall 88 and the second bottom wall 84. A third cutaway 104 is formed on the second abutting surface 70 of the third long side wall 86. The third cutaway 104 terminates in a rectangular third stop 106 from which the third post 98 extends. A third arm portion 108 is provided when the third cutaway 104 is formed as shown in FIG. 1. A fourth cutaway 110 is formed on the second abutting surface 70 of the fourth long side wall 88. The fourth cutaway 110 terminates in a rectangular fourth stop 112 in which a third blind aperture 114 is formed. A fourth arm portion 116 is provided when the fourth cutaway 110 is formed as shown in FIG. 1. A fourth blind aperture 118 is formed at the junction of the fourth long side wall 88 and the second bottom wall 84.

The cylindrical movable contact 14 includes first and second terminal ends and the movable contact 14 is mounted in the through holes 45 of the opposed wall portions 30*b*, 30*d* positioning the movable contact 14 in transverse relation to the cavity 24.

Figure 12:
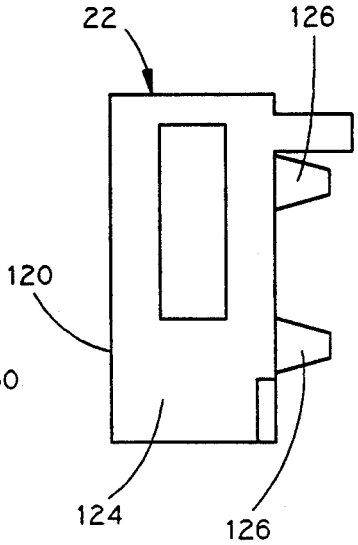
FIG. 12 is a side elevational view of the bracket according to the invention.
Figure 13:
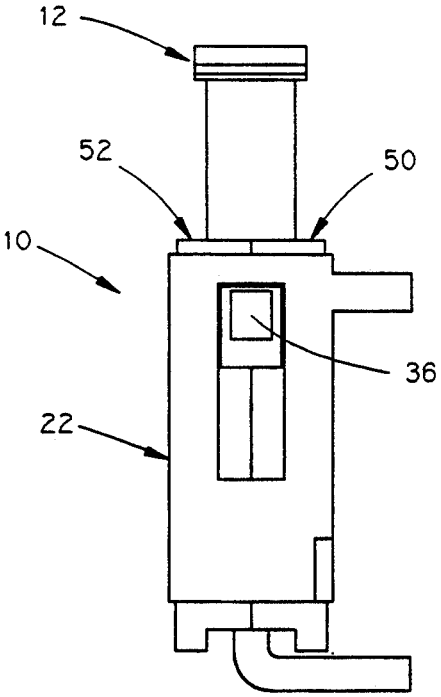
FIG. 13 is a front end elevational view of the switch shown in FIG. 10 with the actuator in a raised position.

The bracket 22 includes a foundation portion 120, generally rectangular in configuration having a rectangular first side part 122 extending integrally from one long side edge thereof, and a rectangular second side part 124 extending integrally from the other long side edge thereof in spaced parallel relation with the first side part 122 as shown in FIG. 12. Each of the long side edges of the first and second side parts 122, 124 includes a pair of spaced, engagement appendages 126 as best shown in FIG. 12.

Figure 14:
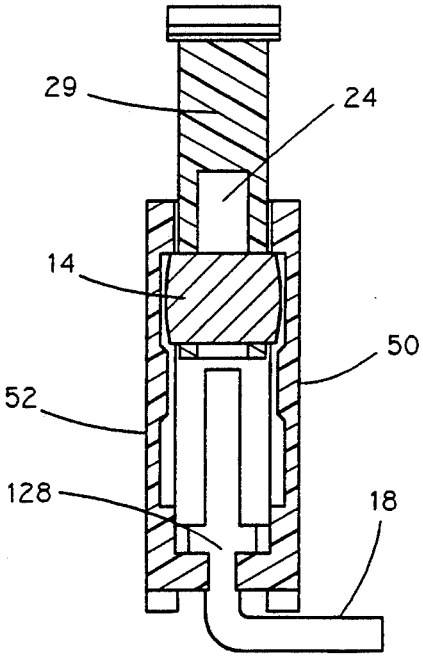
FIG. 14 is a section of the assembled switch shown in FIG. 13.

The first and second fixed contacts 18, 20 are narrow, flat and rectangular in configuration having one terminal end bent at right angles to the remaining portion of the contact. An engagement portion 128 extends from each long side edge of each of the first and second fixed contacts 18, 20 proximate the bend as shown in FIG. 14. The interior surfaces of each of the first and second portions 50, 52 of the housing 16 in close proximity to the first, second, third and fourth half openings 64, 66, 94, 96 includes a pair of depressions within which the engagement portions 128 of the first and second fixed contacts 18, 20 extend.

Figure 8:
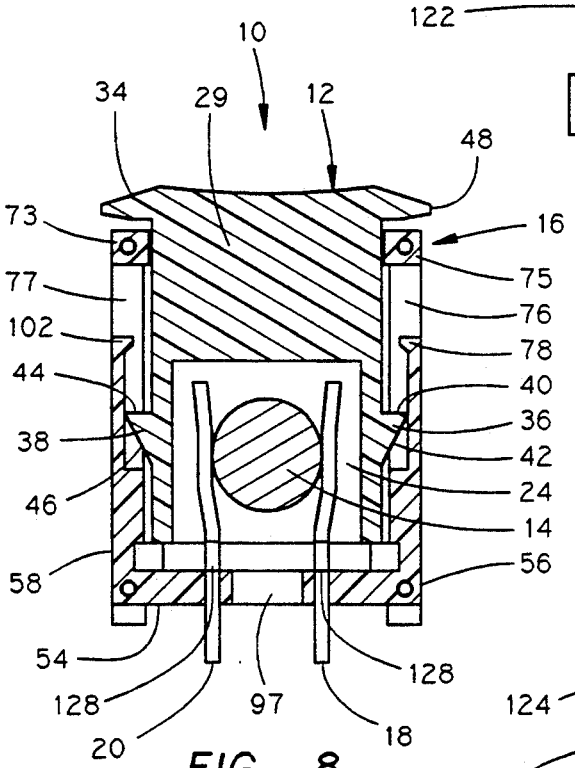
FIG. 8 is a section of the assembled switch shown in FIG. 7.
Figure 9:
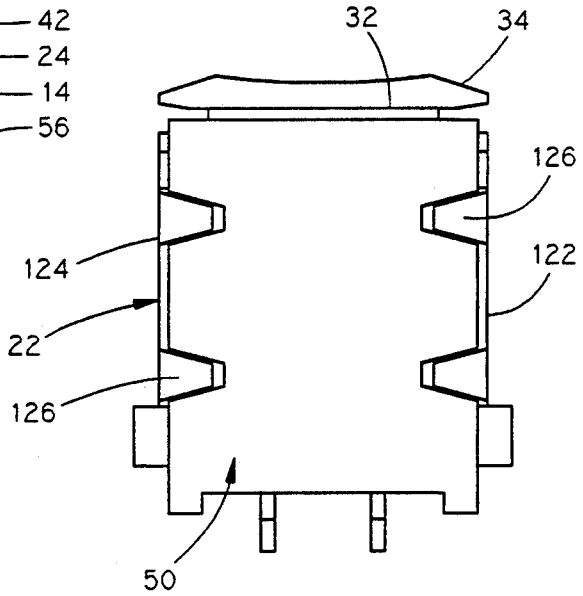
FIG. 9 is a rear side elevational view of the assembled switch shown in FIG. 7.
Figure 10:
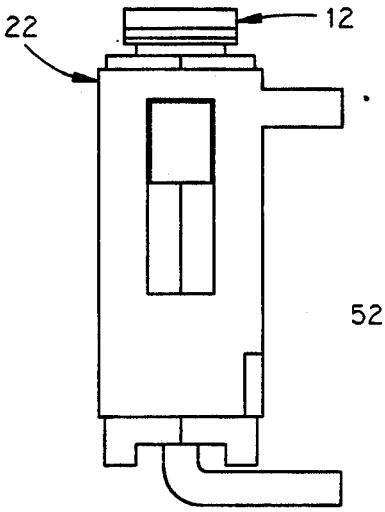
FIG. 10 is a front end elevational view of the switch according to the invention completely assembled.
Figure 11:
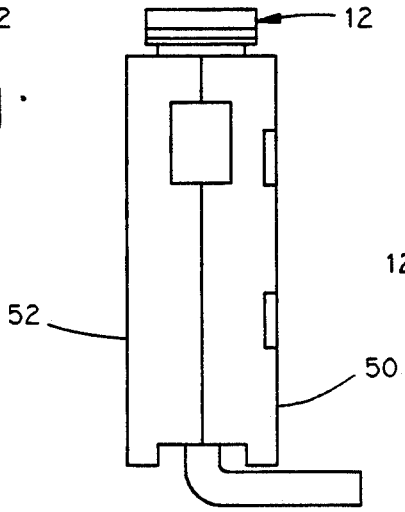
FIG. 11 is a rear end elevational view of the switch shown in FIG. 10.

To assemble the switch 10, the actuator 12 is positioned in the first portion 50 of the housing 16 with the first projection 36 inserted within the first cutaway 76 and second projection 38 inserted within the second cutaway 77. The cap 34 of the actuator 12 is spaced above the upper surface of the first portion 50 as shown in FIG. 8. The first fixed contact 18 is positioned in the first half opening 64 with its engagement portions 128 within the flanking pair of depressions as shown in FIG. 14. The second fixed contact 20 is positioned in the second half opening 66 with its engagement portions 128 within the flanking pair of depressions. The second portion 52 is meshed with the subassembly of the first portion 50, actuator 12 and the first and second fixed contacts 18, 20 by inserting the third post 98 into the first blind aperture 80, the fourth post 100 into the second blind aperture 82, the first post 72 into the third blind aperture 114 and the second post 74 into the fourth blind aperture 118. Each of these engagements is a press fit trapping the actuator 12 and the first and second fixed contacts 18, 20 within the housing 16. The actuator 12 is adapted to move toward and away from the first and second fixed contacts 18, 20 within the housing 16. The bracket 22 is engaged to the subassembly of the housing 16, the actuator 12, the first and second fixed contacts 18, 20 and the movable contact 14 by abutting the inner surface of the foundation portion 120 against the outer surface of the second portion 52 and the engagement appendages 126 are bent into engagement with slots formed on the outer surface of the first portion 50 as shown in FIG. 9.

What I claimed is:

1. An electric switch comprising an actuator, a movable contact, a housing, a first fixed contact, a second fixed contact and a bracket, the housing having a first portion and a second portion, the first portion having an outer surface, and slots formed on the outer surface the bracket including a generally rectangular foundation portion having a pair of opposite long side edges a rectangular first side part extending integrally from one of said long side edges, and a rectangular second side part extending integrally from the opposite long side edge thereof and in spaced parallel relation with the first side part, each of the first and second side parts includes a pair of spaced engagement appendages wherein the bracket is engaged to the housing, by abutting an inner surface of the foundation portion against an outer surface of the second portion and bending the engagement appendages into engagement with the slots formed on the outer surface of the first portion, the movable contact being cylindrical in configuration, the actuator, being of one piece construction, includes cavity and a bottom surface, the bottom surface defining an opening into the cavity, the actuator also having a block portion from which four wall portions extend to define the cavity and the block portion including an upper surface, two of the wall portions being in spaced opposed relation to each other, the opposed wall portions each having a through hole whose diameter is substantially equal to the diameter of the movable contact, the housing including a cavity section and having a bottom wall, the bottom wall having a first through aperture and a second through aperture, the first and second apertures spaced from each other wherein the, first through aperture holds the first fixed contact, and the second through aperture holds the second fixed contact, with a portion of each of the first and second fixed contacts extending into the cavity section and a portion of each of the first and second fixed contacts extending externally of the housing, the actuator movably positioned within the housing with the four wall portions extending within the housing, the movable contact engaged to the through holes and transversely positioned in the cavity whereby movement of the actuator toward the bottom wall will force the movable contact between and into abutting relation with fixed contacts which are adapted to actuate the circuit to which the switch may be connected.

2. An electric switch comprising an actuator, a movable contact, a housing, a first fixed contact, a second fixed contact and a bracket, the housing having a first portion and a second portion, the first portion having an outer surface with slots formed thereon, the bracket including a foundation portion having a one long side edge and a second long side edge, the foundation portion generally rectangular in configuration and having a rectangular first side part extending integrally from said one long side edge thereof, and a rectangular second side part extending integrally from the second long side edge thereof and in spaced parallel relation with the first side part, each of the first and second side parts includes a pair of spaced, engagement appendages, whereby the bracket is engaged to the housing, by abutting an inner surface of the foundation portion against an outer surface of the second portion and bending the engagement appendages into engagement with the slots formed on the outer surface of the first portion, the movable contact being cylindrical in configuration, the actuator, being of one piece construction, includes a cavity and a bottom surface, the bottom surface defining an opening into the cavity, the actuator also having a block portion from which four wall portions extend to define the cavity and the block portion including an upper surface, two of the wall portions being in spaced opposed relation to each other, the opposed wall portions each having a through hole whose diameter is substantially equal to the diameter of the movable contact, the housing including a cavity section and having a bottom wall, the bottom wall having a first through aperture and a second through aperture, the first and second apertures spaced from each other, the first through aperture holds the first fixed contact, and the second through aperture holds the second fixed contact, with a portion of each of the first and second fixed contacts extending into the cavity section and a portion of each of the first and second fixed contacts extending externally of the housing, the actuator movably positioned within the housing with the four wall portions extending within the housing, the movable contact engaged to the through holes and transversely positioned in the cavity whereby movement of the actuator toward the bottom wall will force the movable contact into abutting relation with fixed contacts which are adapted to actuate the circuit to which the switch may be connected, the first and second portions of the housing being identical, the first portion comprising a first bottom wall, first and second long side walls, a first external wall and a first cavity section, the first external wall having an inner surface and side edges, the first bottom wall and the first and second long side walls extend integrally from the inner surface of the first external wall defining the first cavity section and an upper opening, the first and second long side walls each having a top end, the second portion includes a second bottom wall, third and fourth long side walls, a second external wall and a second cavity section, the second external wall having an inner surface and side edges, the second bottom wall and the third and fourth long side walls extend integrally from the inner surface of the second external wall defining the second cavity section and an upper opening, the third and forth long side walls each having a top end, a first post extends from the top end of the first long side wall, a second post extends from the junction of the first long side wall and the first bottom wall, a first blind aperture formed at the top end of the second long side wall, a second blind aperture is formed at the junction of the second long side wall and the first bottom wall, a third post extends from the top end of the third long side wall, a fourth post extends from the junction of the fourth long side wall and the second bottom wall, a third blind aperture formed at the top end of the fourth long side wall, a fourth blind aperture is formed at the junction of the fourth long side wall and the second bottom wall, the first and second portions of the housing are assembled by press fitting the third post into the first blind aperture, the fourth post into the second blind aperture, the first post into the third blind aperture and the second post into the fourth blind aperture, thereby trapping the assembled actuator and the first and second fixed contacts within the housing.

3. An electric switch as set forth in claim 2 wherein the first long side wall includes a first abutting surface, a first cutaway formed on the first abutting surface, the first cutaway terminating in a rectangular first stop from which the first post extends, a first arm portion being provided at the formation of the first cutaway, the second long side wall includes a second abutting surface, a second cutaway formed on the second abutting surface of the second long side wall, the second cutaway terminating in a second stop on which the first blind aperture is formed, a second arm portion being provided at the formation of the second cutaway, the wall portions include a first external surface and a second external surface, a first projection extends from first external surface and a second projection extends from the second external surface whereby movement of the actuator causes the projections to ride in the cutaway.

* * * * *